US008991518B2

(12) United States Patent
Elsmark

(10) Patent No.: US 8,991,518 B2
(45) Date of Patent: Mar. 31, 2015

(54) PORTABLE POWER WRENCH WITH A GEAR CASING AND A PARAMETER SENSING DEVICE

(75) Inventor: Karl Johan Lars Elsmark, Salsjö-Boo (SE)

(73) Assignee: Atlas Copco Industrial Technique Aktiebolag, Stockholm (SE)

( * ) Notice: Subject to any disclaimer, the term of this patent is extended or adjusted under 35 U.S.C. 154(b) by 656 days.

(21) Appl. No.: 13/377,426

(22) PCT Filed: Jun. 11, 2010

(86) PCT No.: PCT/SE2010/050656

§ 371 (c)(1),
(2), (4) Date: Dec. 9, 2011

(87) PCT Pub. No.: WO2010/144048

PCT Pub. Date: Dec. 16, 2010

(65) Prior Publication Data

US 2012/0085562 A1 Apr. 12, 2012

(30) Foreign Application Priority Data

Jun. 11, 2009 (SE) ..... 0900795

(51) Int. Cl.
*B25B 23/14* (2006.01)
*B25B 23/00* (2006.01)
(Continued)

(52) U.S. Cl.
CPC ..... *B25B 23/0078* (2013.01); *B25B 21/00* (2013.01); *B25B 23/14* (2013.01); *B25B 23/147* (2013.01)
USPC ..... 173/217; 73/862.21; 73/862.23; 173/213; 173/216

(58) Field of Classification Search
CPC ..... B25B 23/00; B25B 23/147; B25B 21/00
USPC ..... 173/2, 181, 217, 213, 216; 73/862.191, 73/862.21, 862.22, 862.27, 862.31
See application file for complete search history.

(56) References Cited

U.S. PATENT DOCUMENTS 5,404,775 A * 4/1995 Abe ..... 81/469
5,874,681 A 2/1999 Habele
(Continued)

FOREIGN PATENT DOCUMENTS

DE 4210201 A 9/1993
DE 19637934 A1 3/1998
(Continued)

OTHER PUBLICATIONS

International Search Report dated Sep. 8, 2919 issued in International Appln. No. PCT/SE2010/050656.

*Primary Examiner* — Thanh Truong
*Assistant Examiner* — Justin Citrin
(74) *Attorney, Agent, or Firm* — Holtz, Holtz, Goodman & Chick PC

(57) ABSTRACT

A portable power wrench is controlled by an operation control unit and comprises a housing (10;50) with a rotation motor, a gear casing (15;55) including a gearing (18;56,57) and a drive spindle (19;60} and being releasably and/or rotatably connected to the housing via a swivel or multi-position connection, an operation parameter sensing device (22,23;68) is associated with the drive spindle (19,60). The sensing device (22,23;68) communicates with the operation control unit via a first signal transferring device (28;82) which is disposed between the drive spindle (19;60) and the gear casing (15;55), and a second signal transferring device (31;84) is disposed between the gear casing (15;55) and the housing (10;50), wherein the second signal transferring device (31;84) communicates with the operation control unit. At least the first signal transferring device (28;82) between the drive spindle (19;60) and the gear casing (15;55) comprises a contact free transfer device.

5 Claims, 2 Drawing Sheets

(51) Int. Cl.
*B25B 21/00* (2006.01)
*B25B 23/147* (2006.01)

(56) References Cited

U.S. PATENT DOCUMENTS

| | | | | |
|---|---|---|---|---|
| 7,086,483 | B2 * | 8/2006 | Arimura et al. | 173/217 |
| 7,275,450 | B2 * | 10/2007 | Hirai et al. | 73/862.21 |
| 7,963,346 | B2 * | 6/2011 | Brodin | 173/217 |
| 2007/0144753 | A1 * | 6/2007 | Miller | 173/217 |
| 2007/0298927 | A1 * | 12/2007 | Hansson | 475/339 |
| 2009/0255700 | A1 * | 10/2009 | Lehnert et al. | 173/104 |

FOREIGN PATENT DOCUMENTS

| | | | |
|---|---|---|---|
| DE | 10237728 | A1 | 2/2004 |
| DE | 202004017472 | U1 | 1/2005 |
| GB | 2 293 012 | A | 3/1996 |
| WO | WO 03006211 | A1 | 1/2003 |
| WO | WO 2009051543 | A1 * | 4/2009 |

* cited by examiner

PORTABLE POWER WRENCH WITH A GEAR CASING AND A PARAMETER SENSING DEVICE

BACKGROUND OF THE INVENTION

1. Field of the Invention

The invention relates to a portable power wrench comprising a housing with a rotation motor, a gear casing including a gearing and an output shaft, wherein the gear casing is rotatively and/or releasably connected to the housing via a swivel or multi-position connection.

In particular the invention concerns a power wrench of the above type wherein at least one operation parameter sensing device is located in the gear casing and connected to an operation control unit, and a means for transferring signals between the operation parameter sensing means in the gear casing and the housing.

2. Description of the Related Art

In power wrenches provided with operation parameter sensing devices like torque transducers it is an advantage from the signal accuracy point of view to locate the torque transducer as close as possible to the screw joint being tightened, e.g. on the output shaft of the power wrench or at least on a rotating part in the gear casing. This is a previously well known want. It is also previously known to have sensing means activating power as well as generated signals transferred between the sensing means and the wrench housing via different types of signal transferring means.

A particular signal transmission problem occurs in power wrenches having a forward gear casing that is rotatively and/or releasably supported on the power wrench housing via a swivel or multi-position connection. A power wrench of this type is previously described in for instance U.S. Pat. No. 4,485,698. When such a power wrench is provided with one or more operation parameter sensing devices located in the gear casing the signals generated thereby have to be transferred from the gear casing to an electronic operation control unit which is provided either in the tool housing or in a stationary unit separate from the power wrench. In both cases there is a requirement to obtain a simple yet reliable transfer of signals from the sensing device or devices in the gear casing to a wiring in the housing for further transport to a control unit, in the housing or at a remote location.

BRIEF SUMMARY OF THE INVENTION

It is an object of the invention to provide a portable power wrench comprising a housing, a gear casing rotatively and/or releasably supported on the housing via a swivel or multi-position connection, wherein the gear casing comprises at least one power transferring rotating part, and at least one operation parameter sensing device, and movement admitting signal transferring devices provided to transfer operation parameter related signals generated by the sensing device or devices to the gear casing and the wrench housing.

It is another object of the invention to provide a portable power wrench comprising a housing, a gear casing rotatively and/or releasably supported on the housing via swivel connection, wherein the gear casing comprises at least one power transferring rotating part, and at least one operation parameter sensing device associated with the power transferring rotating part, and a contact free movement admitting signal transferring device arranged between the rotating part and the gear casing.

Still another object of the invention is to provide a portable power wrench comprising a housing, a gear casing rotatively and/or releasably supported on the housing and comprising a power transferring rotating part, at least one operation parameter sensing device associated with the power transferring rotating part, and signal treating electronic components connected to the sensing device, wherein the power transferring rotating part is formed with a coaxial cavity in which the electronic components are located.

Further objects and advantages of the invention will appear from the following specification and claims.

Preferred embodiments of the invention are described below with reference to the accompanying drawings.

DESCRIPTION OF THE PREFERRED EMBODIMENTS

Figure 1:
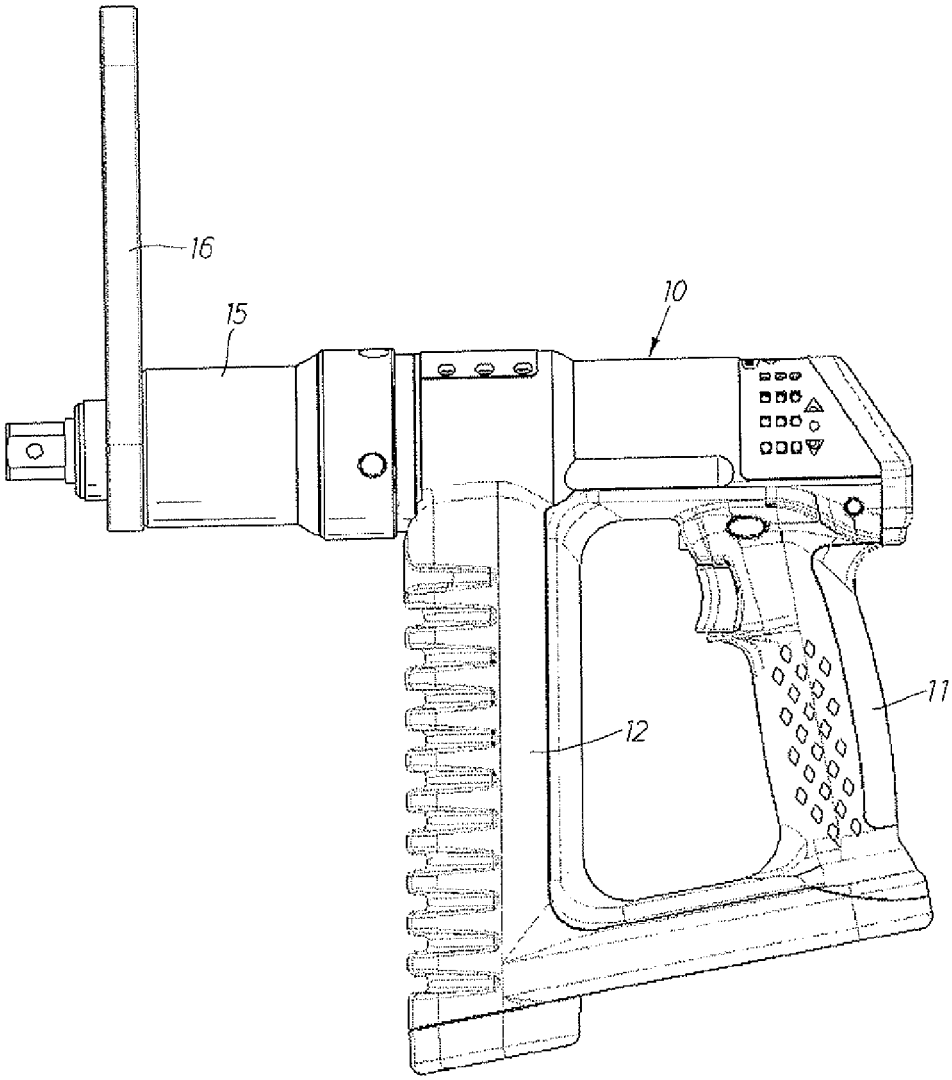
FIG. 1 shows a side view of a power wrench according to the invention.
Figure 2:
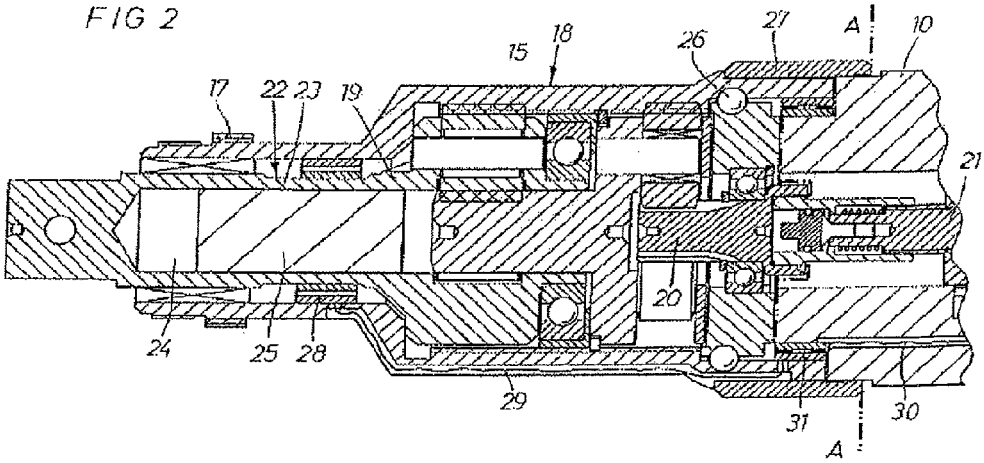
FIG. 2 shows a longitudinal section through the gear casing of the power wrench in FIG. 1.

The power wrench illustrated in FIGS. 1 and 2 comprises a housing 10 with a rear handle 11 and a motor section 12 extending substantially in parallel with the handle 11 and enclosing a rotation motor. A gear casing 15 is rotatively and releasably connected to the housing 10 and carries a torque reaction bar 16 at its forward end. The torque reaction bar 16 is supported and rotationally locked relative to the gear casing 15 via a splines portion 17. The interface between the housing 10 and the gear casing 15 is illustrated by a line A-A.

The gear casing 15 is axially locked relative to the housing 10 in a conventional way by balls 26 engaging grooves in the two parts, and a maneuver sleeve 27 is movably supported on the housing 10 and arranged to retain the balls 26 in their locking positions and to release the gear casing 15 by letting the balls 26 disengage at least one of the grooves.

The gear casing 15 comprises a two stage planetary type reduction gearing 18 and power transferring drive spindle 19. The latter forms a square ended output shaft for connection to a nut socket. The first stage of the reduction gearing 18 comprises a sun gear 20 which is coupled to the motor via a connection shaft 21 and a non-illustrated angle drive. The gear casing 15 is one of a number of interchangeable gear casings, wherein the gear ratios of the gear casings are different. So, by changing gear casing it is possible to obtain a different gear ratio. However, the reduction gearing 18 per se is of a conventional type, and since it does not form any part of the invention it is not described in further detail.

The drive spindle 19 is provided with a torque sensing device 22 comprising an elastically deformable weak portion 23 of the drive spindle 19 and a strain gauge arrangement (not illustrated in further detail) fitted thereto. The drive spindle 19 is provided with a coaxial cavity 24, and the weak portion 23 is formed by the circumferential wall of the cavity 24. The cavity 24 could also be arranged non-coaxilly as long as the spindle with its components is balanced and has symmetrical properties to allow reliable signals from the strain gauges. Inside the cavity 24 there are located a number of electronic components forming a signal treating unit 25 connected to the strain gauge arrangement.

The signals produced by the torque sensing device 22 are transferred to an operation control unit for controlling the power wrench operation in relation to feed back signals received from the torque sensing device 22. The control unit is not illustrated per se but is located either in the housing 10 or at a remote location separate from the wrench. In any case, the signals produced by the torque sensing device 22 have to be transferred to the housing 10. The very first step to do this is to transfer the signals from the drive spindle 19 to the gear casing 15. This is accomplished by a first contact free signal transferring device 28 which is connected to electric leads 29 in the gear casing 15. This signal transferring device 28 is illustrated schematically only and may be of any known contact free type, for instance an induction device comprising magnets and coils, a device including a magnetostrictive material in the output spindle, a telemetric signal transferring device etc.

For transferring the torque sensor signals from the gear casing 15 to the housing 10 and to the control unit there is provided a second signal transferring device 31, and an electric wiring 30 is provided in the housing 10 to connect the device 31 with the control unit, directly if located in the housing or via an external cable if located remotely from the wrench. The second signal transferring device 31 may be of a contact free type or a brush type. Since the rotation between the gear casing 15 relative to the housing 10 is relatively limited there will be no mechanical wear and that a brush type of signal transferring device will be safe and reliable enough.

In high power wrenches where a torque reaction bar is used to transfer the reaction forces to a suitable structure and to protect the operator from being exposed to these forces it is important that the gear casing on which the torque reaction bar is attached is rotatable or swivelled relative to the wrench housing and handle. This means that when an operation parameter sensing device, for instance a torque transducer, is provided on or close to the output shaft of the wrench there has to be a rotation admitting signal transferring device not only between the drive spindle/output shaft and the gear casing but also between the gear casing and the housing. In order to avoid mechanical wear and bad contact the signal transferring device between the drive spindle/output shaft and the gear casing has to be contact free. However, the signal transferring device provided between the gear casing and the housing is not exposed to such an extensive rotational movement, which means that the signal transferring device provided between these two parts may be of a simple brush type, as mentioned above.

The arrangement of a first and a second rotatable signal transferring devices makes it possible to locate an operation parameter sensing device on or close to the output shaft wherein the gear casing is rotatable and releasable relative to the wrench housing. It also means that the gear casing with an operation parameter sensing device which has been calibrated at its installation in relation to the actual application and a torque reaction bar fitted may be easily removable as a unit and exchanged for another gear casing unit with another gear ratio and/or torque reaction bar fitted.

Figure 3:
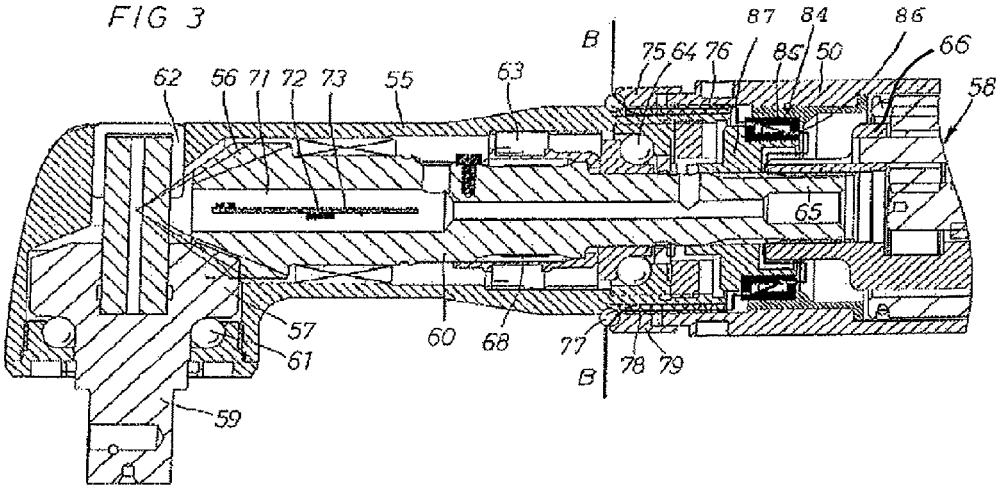
FIG. 3 shows a longitudinal section through the gear casing of a power wrench according to an alternative embodiment of the invention.

In FIG. 3 there is illustrated the front part of an angle type power wrench which comprises a housing 50 in which there is located a rotation motor and a planet type reduction gearing 58. The front part of the power wrench comprises a gear casing 55 with an angle gear including a pinion 56 and a bevel gear 57. The bevel gear 57 is formed integrally with a square ended output shaft 59 which is supported in bearings 61, 62. The pinion 56 is formed integrally with a drive spindle 60 which is supported by bearings 63, 64. At its rear end the drive spindle 60 is formed with a splined portion 65 for releasable drive connection with a planet wheel carrier 66 of the reduction gearing 58.

A torque sensor comprising strain gauges 68 is attached to the drive spindle 60 so as to be activated by torsional elastic deformation of the drive spindle 60 during torque transfer. The drive spindle 60 comprises an internal co-axial cavity 71, wherein a printed circuit board 73 is located. The cavity 71 could also be arranged non-coaxilly as long as the spindle with its components is balanced and has symmetrical properties to allow reliable signals from the strain gauges. The circuit board 73 carries electronic components 72 connected to the strain gauges 68 and arranged to treat the signals delivered by those. The circuit board 73 also comprises a memory unit for storing operation parameter data and/or the number of operation cycles performed by the gear casing.

The gear casing 55 is formed with a rear neck portion 75 to be received in a socket portion 76 of the housing 50. The gear casing 55 is axially locked to the housing 50 by balls 77 and rotationally locked thereto by a splines connection 78. The balls 77 are retained in their locking positions by a maneuver sleeve 79 movably supported on the housing 50. The interface between the gear casing 55 and the housing 50 is illustrated by a line B-B.

The electric signals generated by the strain gauges 68 and treated by the electronic components 72 on the circuit board 73 are transferred to the housing 50 via a transferring device 84. The latter comprises a stationary part 85 supported on the housing 50 and a rotating part 86 supported on a carrier element 87 secured to the rear portion 65 of the drive spindle 60. In order to avoid mechanical wear and disturbances related thereto this signal transferring device 84 is of a contact free type, for instance inductive or telemetric.

In the housing 50 there is provided a non-illustrated wiring for connecting the second signal transferring device 84 with an operation control unit which is not illustrated per se but is located either in the housing 50 or at a remote location separate from the power wrench.

By providing a separate and releasable and/or exchangeable gear casing to the housing of a power wrench with at least one operation sensing means associated with the drive spindle and signal transferring devices between the drive spindle and the gear casing on one hand and between the gear casing and the power wrench housing on the other hand, as specified by the invention, provides the advantage of having a separate and exchangeable gear casing which is complete with calibrated operation sensing means which is automatically and simultaneously connected to an operation control unit as the gear casing is attached to the power wrench housing. This avoids sources of error and bad contacts and makes it possible to locate the operation sensing means after the reduction gearing, thereby avoiding to a large extent signal distortions.

The invention claimed is:

1. A portable power wrench comprising a housing, a rotation motor, a gear casing supported on the housing and comprising a gearing and a transferring drive spindle, and at least one operation parameter sensing device associated with the drive spindle, wherein:

the drive spindle comprises a coaxial internal cavity, signal treating electronic components are located in said cavity and connected to the at least one operation parameter sensing device, and the portable power wrench further comprises a signal transferring device communicating with said electronic components and arranged to transfer to the housing signals generated by the at least one operation parameter sensing device and treated by said electronic components.

2. The portable power wrench according to claim 1, wherein a memory unit for storing operation parameter data is located in said cavity, and said electronic components and said memory unit are disposed on a common circuit board.

3. The portable power wrench according to claim 2, wherein the gear casing forms a separate unit exchangeably attached to the housing, and the memory unit with operation data relevant to a particular gear casing is a part of said particular gear casing.

4. The portable power wrench according to claim 1, wherein the drive spindle has a rear end portion extending into the housing, and said signal transferring device comprises a rotating part connected to said rear end portion of the drive spindle and a stationary part mounted in the housing.

5. The portable power wrench according to claim 1, wherein the gear casing comprises a gearing of a certain gear ratio, and the gear casing is one of a number of interchangeable gear casings having gearings of different gear ratios.

* * * * *